US005358024A

United States Patent [19]

Schwaegerle

[11] Patent Number: 5,358,024

[45] Date of Patent: Oct. 25, 1994

[54] WEB COVERED VERTICAL BLIND SLAT ASSEMBLIES

[75] Inventor: Paul R. Schwaegerle, Oberlin, Ohio

[73] Assignee: The Geon Company, Independence, Ohio

[21] Appl. No.: 120,312

[22] Filed: Sep. 13, 1993

Related U.S. Application Data

[60] Continuation of Ser. No. 898,659, Jun. 15, 1992, abandoned, which is a division of Ser. No. 762,036, Sep. 17, 1991, Pat. No. 5,141,042, which is a continuation of Ser. No. 459,890, Jan. 20, 1990, abandoned.

[51] Int. Cl.[5] ..... E06B 9/00

[52] U.S. Cl. ..... 160/236; 160/900

[58] Field of Search ..... 160/236, 900, 178.1, 160/168.1, 176.1, 166.1; 29/24.5; 139/384 A

[56] References Cited

U.S. PATENT DOCUMENTS

| | | | |
|---|---|---|---|
| 4,049,038 | 9/1977 | Hyman et al. | 160/236 |
| 4,276,954 | 7/1981 | Romano | 160/236 |
| 5,049,424 | 9/1991 | Carden et al. | 160/236 X |
| 5,105,870 | 4/1992 | Merjane | 160/236 |
| 5,141,042 | 8/1992 | Schwaegerle | 160/236 |
| 5,271,447 | 12/1993 | Aronovich | 160/236 |

*Primary Examiner*—Blair M. Johnson

*Attorney, Agent, or Firm*—Miles B. Dearth

[57] ABSTRACT

An elongate substantially rectangular louver or assembly of louvers each comprising an elongate conformable web sleeve or web envelope which substantially or completely surrounds and conforms generally to the periphery of a slat inserted therein and which said louver has a depending means for removable attachment to a louver assembly support means and said slat is removably attached to said web sleeve or web envelope.

4 Claims, 10 Drawing Sheets

FIG. 1A
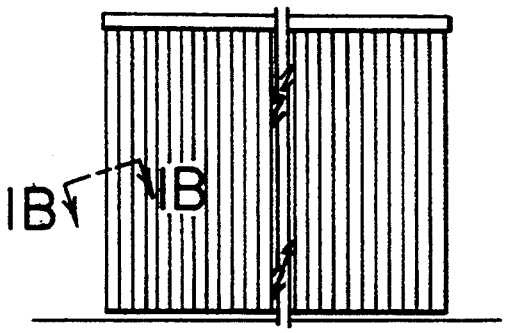
FIG. 1B
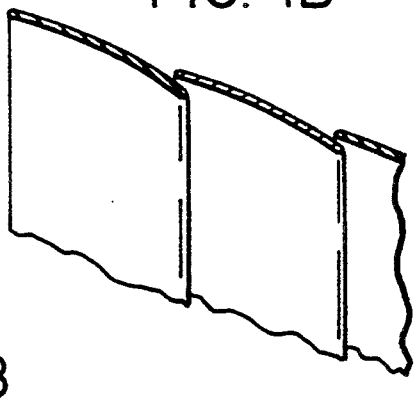
FIG. 2B
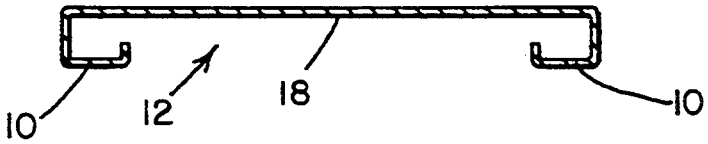
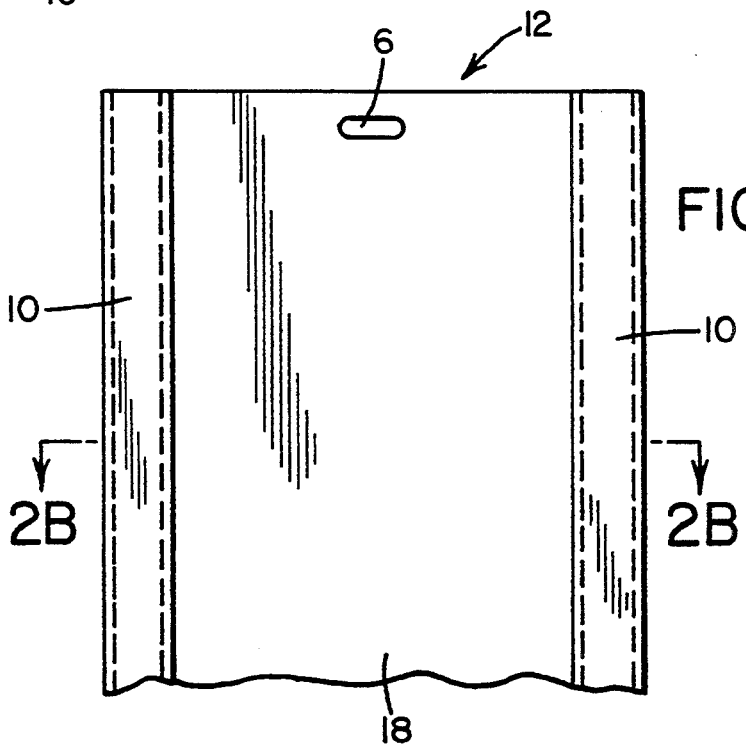
FIG. 2A

WEB COVERED VERTICAL BLIND SLAT ASSEMBLIES

This is a continuation of Ser. No. 07/898,659 filed Jun. 15, 1992, abandoned, which is a division of Ser. No. 07/762,036 filed Sep. 17, 1991, now U.S. Pat. No. 5,141,042 which is a continuation of Ser. No. 07/459,890, filed Jan. 2, 1990, now abandoned.

BACKGROUND OF THE INVENTION

The present invention is directed to novel louvered assemblies for closing or obscuring an opening, and more particularly relates to modifications to conventional louver assemblies to improve the aesthetic appearance of the assembly without impairing its integrity of function.

An early louvered assembly, commonly referred to as a venetian blind, consists of a number of horizontal slats that can be set simultaneously to varying degrees of slant so as to change the amount of light admitted and the view seen through an opening. Recently vertical louvered systems have become popular. Recent improvements that have been suggested are directed toward aesthetic quality, appearance or fashion imparted to an otherwise drab but necessary mechanism for controlling light or privacy through the view of the opening in which it is placed. A fundamental requirement of the slats, which generally are thin, elongate members, employed in louvered systems is that they must sustain their shape when brought together in alignment so as to completely and continuously occlude the openings. In order to avoid curling, the louver slats can be curved laterally in the narrow dimension so as to provide additional rigidity to the slats. Decorating modifications of horizontal slats generally are restricted to lightweight, thin webs which are attached to the slats, but do not alter the slat structure and strength properties of the slats.

U.S. Pat. No. 2,074,482 granted in 1937 to Ernest Martens discloses a decorative improvement to the slats of a venetian blind. The slats are made of rigid, transparent composition wherein an opening or slot within the slat accepts a removable decorative filler or insert. The insert is opaque or translucent to an extent that a decorative design can be contrasted against the incident light through the opening. Many types of filler materials are described which permit changing the appearance of the assembly from time to time as one desires. The fillers impart a design or coloration to an otherwise transparent slat. Without the fillers, the slats would not serve the purpose of adjustable occluding the light or the view through the opening.

Vertical louvered assemblies, which recently have become popular comprise relatively thin, elongated vertical hanging slats which are suspended and depend vertically from a mechanism which aligns and orients the slats. Typically the depending slats overlap slightly and can be rotated in unison to infinitely adjust the light or view through the opening. The slats are made from a wide variety of materials including extruded vinyl strips and are optionally decorated by attaching webs, narrow woven or slit fabrics, or laminated films. Closely related to the present invention are elaborate vertical slat assemblies involving the familiar combinations of a slat member and a decorative member which is inserted thereupon to the face, back or both sides of the slat with attachment means.

The vertical louver described in U.S. Pat. No. 4,049,038 comprises lateral inwardly facing flanges on one or both faces of the slat which will receive an insert such as a strip of wallpaper or fabric.

U.S. Pat. No. 4,628,980 incorporates improved transparent flange portions of a similar configuration. In commercial practice the louver is coextruded with the opaque flat portion positioned between the flanges. Materials employed for louvers of this type often are polyvinyl chloride polymers.

Owing to the commercial success of the flanged louver described in U.S. Pat. No. 4,049,038, there have been further enhancements which relate to improving the aesthetic appearance of the louvers. Current commercial approaches focus on the decorative treatment of inserts for vinyl or metal louvers.

U.S. Pat. No. 4,773,958 is directed to laminated inserts for use in vertical blind slat assemblies. The method involves laminating a stranded layer such as a fabric to at least a second layer and adhering or removably joining this laminate to a slat member. Laminates can also be attached to both front and back faces of the slat member. The advantage to a retailer separately assembling the laminated inserts and the slat members enables one to inventory one or a relatively few number of slat styles in relation to a large number of insert laminates of varying design and appearance.

Another approach for changing the decor of louver panel inserts is described in U.S. Pat. No. 4,195,680. Multiple clear or translucent tinted films for attachment to flanged louvers are disclosed. Variations in color are achieved by removably attaching one or more inserts each of which have different colors and together form a new color.

U.S. Pat. No. 4,519,435 discloses a method for making slats utilizing two folded fabric strips which make up the front and back faces of the louver. The strips may be joined by a heat activatable bonding material. An additional method of bonding that is described involves thermal or radio frequency bonding of the frontal and backing material directly. The frontal and backing material can be identical in substance, texture or color or they may be of dissimilar substance, texture or color. The bonding material used for bonding the backing and frontal strips is an adhesive or a separate lamina having adhesive properties which can be activated by heat sealing methods. A non-woven scrim fabric or bonding web is suggested. After the entire assembly is brought into position for instance, on a continuous assembly device, it is permanently bonded or set thus precluding movement of the components out of their assembled position. The laminated front and back panels have sufficient body and integrity so as to meet the general requirements of a slat for vertical louver system.

In those instances where inserts are combined with the slat member to modify its appearance, a portion of the slat member still is revealed such as along the side and outward face of the slat where only one insert is placed against the front side of the slat. Also, if the slat is flanged on both sides and frontal inserts are attached, the lateral edges of the slat nevertheless are visible. If the lateral edges are transparent, the edges may be unobtrusive, but still are visible. As such, the overall appearance is that of an elongate plastic member which has one or more decorative attachments. These assemblies, cannot provide the numerous aesthetic features of a continuous web such as a textile fabric web. Conversely, materials typically used for inserts such as textile fabrics or paper do not possess the desired physical properties such as rigidity and resistance to curling to function as a louver slat per se. If these flimsy materials are used as a slat structure, they must be treated with permanent sizing or laminated with reinforcing layers in order to meet the required performance requirements as in U.S. Pat. No. 4,519,435. Much of the aesthetic value and soft handle characteristics of the fabric are lost by such treatments.

It accordingly would be desirable to devise a louver assembly which provides the appearance and aesthetic qualities of a continuous web such as a fabric web structure, that possesses the necessary physical properties such as rigidity and resistance to curling without sizing or other treatment.

SUMMARY OF THE INVENTION

It is an object of the present invention to provide a louver assembly that includes a plurality of louvers each of which comprises an envelope or sleeved web that is reinforced by a louver slat removably inserted therein. The web sleeve or envelope substantially conforms to the shape of the slat inserted therein and essentially or completely encompasses the slat.

It is a further object of the present invention to provide a novel louver comprising said web and slat insert wherein spacing exists between the web and at least one of the slat surfaces in assembled position.

A still further object of the invention is to provide louvers wherein spacing existing between the web and slat insert contains a sound or thermal insulating member of resilient conformable construction having a thickness substantially conforming to the spacing.

An additional object of the present invention is to provide a slat insert, wherein said insert comprises novel attachment means for accepting webs.

In one embodiment of the present invention the web may be formed into a sleeve which accepts a slat insert. The web sleeve may be either continuous as in the case of extruded film or circular knit fabric or the web sleeve is formed by folding an elongate generally rectangular piece inward and joining the lateral edges permanently such as by stitching, sealing or other permanent joining means. In another embodiment of this invention, the web may not be permanently joined to itself, but is simply wrapped around the slat member and removably affixed to the slat insert by attachment means.

The concept of the present invention is essentially the reverse of the conventional methods of modifying a slat member with an insert web strip. In the present invention, the louver slat is the insert and is housed within a surrounding web or webs. The web in this case surrounds and substantially or completely covers the slat insert. The opacity of the web sleeve, or web envelope may be such as to not completely occlude light. The function of the slat insert is primarily for rigidity, it may be a continuous member or a discontinuous member. Preferably the slat insert contains a recessed portion to provide air space between the web and slat. This space can allow for sound deadening media or insulating material. The space also preserves soft tactile properties such as handle to the web. The slat insert will also provide a depending means for the slat assembly. The slat may have opacity or translucency.

Another feature of the present invention is the provision of a web attachment means on the slat insert which removably secures the web placed around the insert. The web attachment means in certain embodiments can accept two separate web components. The ability to employ two different webs allows for substantial latitude in customizing the appearance of the louver. For instance, in hot weather a web of light or white color can be employed to span the outward face of the slat insert while a web of different texture or color can be used for the inward face of the slat insert, both webs being removably secured to said slat insert. During colder months, a dark color on the outward face would be desirable for additional warmth without changing the inward facing webs in the case where the inward side is matched to the room decor. Alternatively, the slat insert may be a discontinuous member such as an open mesh or grid. When this slat is inserted within a porous web sleeve or envelope such as a fabric, the louver assembly allows for privacy while maintaining air flow through the assembly when drawn across the opening. This embodiment may be desirable, for instance, in warm climate areas. These distinct advantages and objects of the present invention will further become evident and readily perceived from the following description of the preferred embodiments thereof when considered with the accompanying drawings and appended claims.

BRIEF DESCRIPTION OF THE DRAWINGS

FIG. 1A is an elevation view of a vertical louver assembly system;

FIG. 1B is an enlarged fragmentary perspective taken approximately on line 1B–1B of FIG. 1A;

FIG. 2A is an elevation view of a flanged louver slat insert;

FIG. 2B is a section view on the line 2B–2B FIG. 1B;

DESCRIPTION OF THE PREFERRED EMBODIMENTS

One louver system described herein comprises a plurality of louvers held vertically by a louver track system. Louvers depend from the track system and are movably aligned. The louver track system allows for rotation of the aligned louvers in unison for adjustment of the light or view through the opening.

Figure 3:
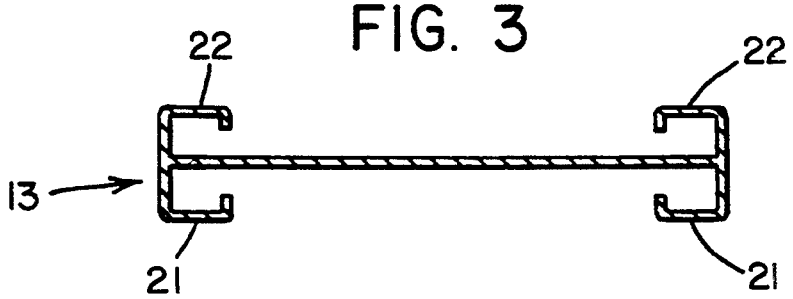
FIGS. 3–6 are cross-section views of 4 embodiments of slat inserts within the preview of this invention.
Figure 4:
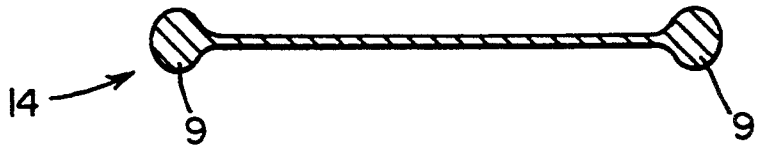
Figure 5:
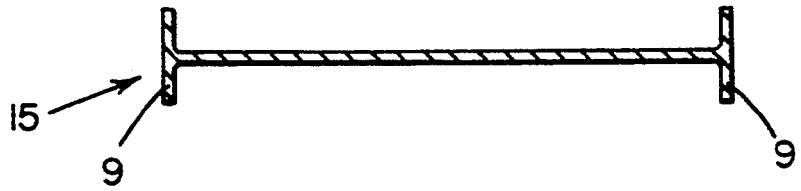
Figure 6:
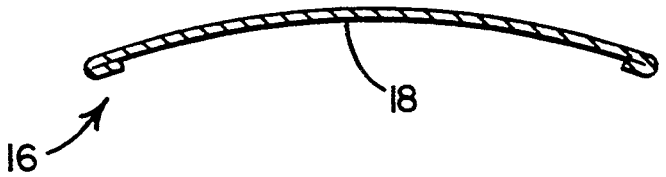
Figure 7:
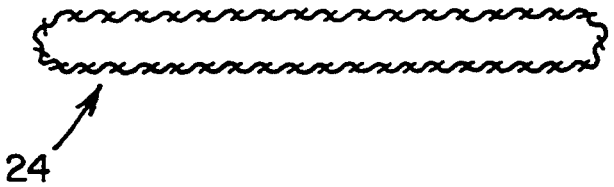
FIGS. 7–10 are cross-section views of 4 embodiments of web sleeves that are within the preview of this invention.
Figure 8:
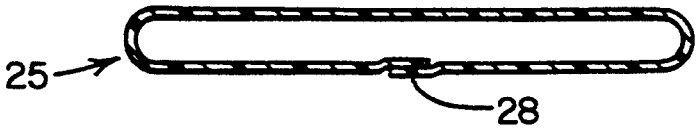
Figure 9:
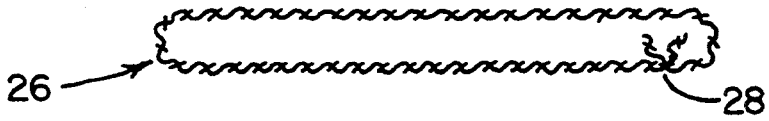
Figure 10:
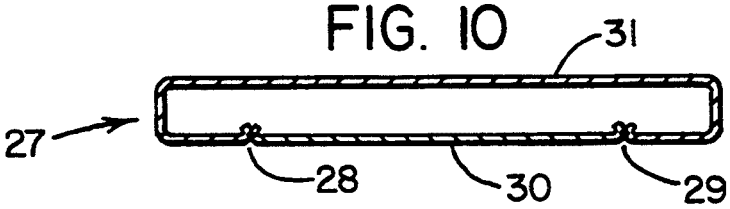

As indicated above, the invention involves a combination of a web and a rigid slat insert both of general rectangular elongate shape. The web or combination of webs generally can be characterized as either a web sleeve or a web envelope. FIGS. 7 to 10 refer to examples of web sleeves. A sleeve is distinguished from an envelope here such that a sleeve is a conformable cylindrical web which is either a continuous tube or comprised of one or more elongate strips joined together permanently along one or more seams. In order to construct a web sleeve which has a single seam, a web material in elongate strip form is folded inward and brought on to itself and sewn or sealed or otherwise joined independently to itself. In FIG. 7 web sleeve 24 is depicted as a continuous fabric such as a circular knitted tube. In FIG. 8 web sleeve 25 is shown constructed by folding a web onto itself and joining by adhesive or other joining or sealing methods. In FIG. 9 sleeve 26 is depicted which is joined onto itself along a seam at 28 by stitching. In FIG. 10 web sleeve 27 is shown with two seams 28 and 29 joining two web members of similar or dissimilar compositions. Inner web member 30 and outer web member 31 are thus joined permanently.

Figure 11:
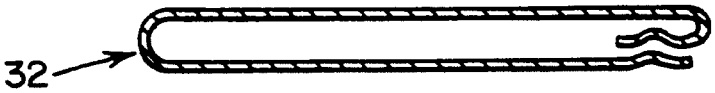
FIGS. 11–13 are cross-section views of 3 additional embodiments of web envelopes.
Figure 12:
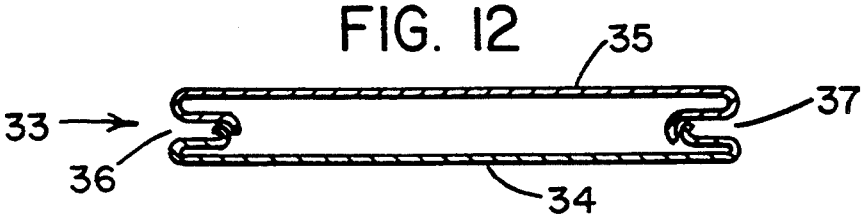
Figure 13:
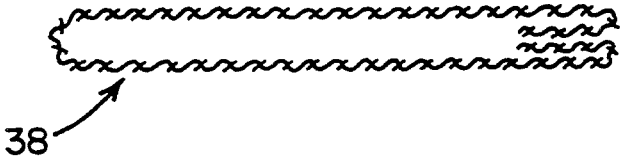

Web envelopes are shown in FIGS. 11 to 13. There are no seams present and the web envelopes are wrapped around a slat insert during assembly. Slat inserts which accept web envelopes have attachment means for retaining one or more web envelopes. The web envelope 32 shown in FIG. 11 is arranged loosely on itself. To aid in visualization it is anticipated that where there is shown an overlap, an attachment means of the web insert will fasten the web envelope at that point. In FIG. 12 web envelope 33 comprises two web members. Inner web 34 and outer web 35 are shown overlapping with each other laterally at 36 and 37. Web envelope 38 is shown in FIG. 13 and is made from textile fabric. Web sleeves or web envelopes can be fabricated from woven fabric, non-woven fabric, laminated fabric, paper, film, laminated film, and the like.

Figure 15:
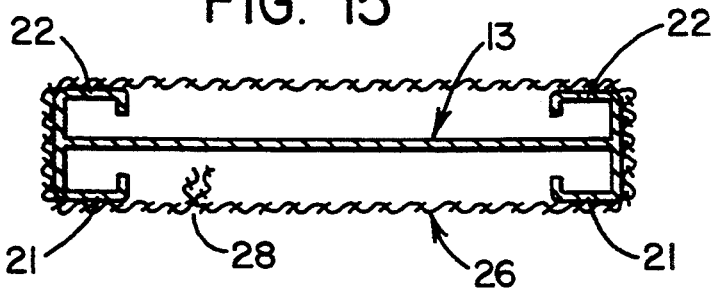
Figure 18:
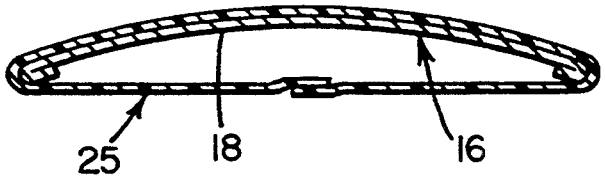

Slat inserts of the present invention can be continuous elongate members or discontinuous within the outer edges which are generally smooth and continuous. For slat inserts which accept web sleeves, web attachment means are not necessary to hold a web sleeve in place. In FIG. 2A slat insert 12 includes depending means at 6 for depending the louver on the louver track system. FIGS. 2A to FIG. 6 depict several embodiments of such louver slat inserts. Slat insert 12 shown in FIG. 2 comprises lateral inwardly facing flanges at 10. Slat insert 13 shown in FIG. 3 comprises inner facing lateral flanges at 21, and outer facing lateral flanges at 22. Slat inserts 14 and 15 shown in FIGS. 4 and 5 respectively comprise lateral thickened regions at 9 extending perpendicular to the faces of the slat. In these examples, the regions do not form grooves. The presence of lateral flanges or thickened regions serves to enhance rigidity and more importantly serves the purpose of creating thickness at the lateral portions only. FIG. 15 illustrates the result of having thickened lateral regions. Within web sleeve 26 medial to the lateral flanges or thickened regions of slat insert 13 is intervening free space as the web spans the medial area of the slat insert. A slat insert can lack substantially any lateral flanges or thickened regions but the slat is curved such as in the case of slat insert 16 shown in FIG. 6. FIG. 18 illustrates the contact between web sleeve 25 and slat insert 16 along the outward face but the sleeve spans the medial area with no contact on the inward face 18 due to the curvature of the slat insert.

The inner circumference of a web sleeve is preferably similar to the outer circumference of the slat insert generally taken as a smooth line drawn around the periphery of the slat insert and contacting the outer .extremes at the lateral areas. It is desirable to create sufficient tension in a web sleeve in order to eliminate wrinkles or puckering at the seams thus presenting a smooth surface when assembled.

Slat inserts which have intricate lateral flanges or thickened regions are best accomplished with the use of an extrudable thermoplastic material such as polyvinyl chloride. Slat inserts which do not have an intricate profile appearance may also be fabricated from wood or a metal such as aluminum. A typical slat insert easily fabricated from aluminum is insert 16 shown in FIG. 6. In the case where the slat inserts have novel attachment means illustrated below, the preferred method of manufacture is extrusion of a thermoplastic polymer, such as polyvinyl chloride.

Figure 14:
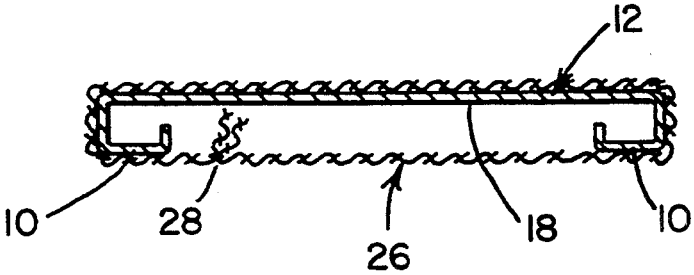
FIGS. 14–19 are cross-section views of 6 embodiments of assembled louvers with slat inserts within web sleeves.
Figure 16:
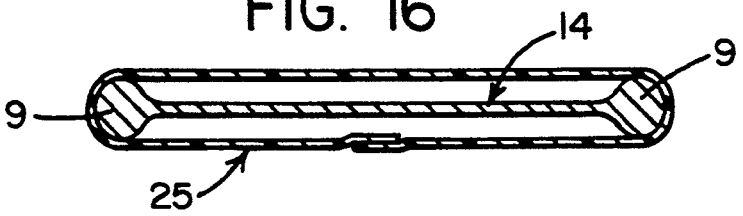
Figure 17:
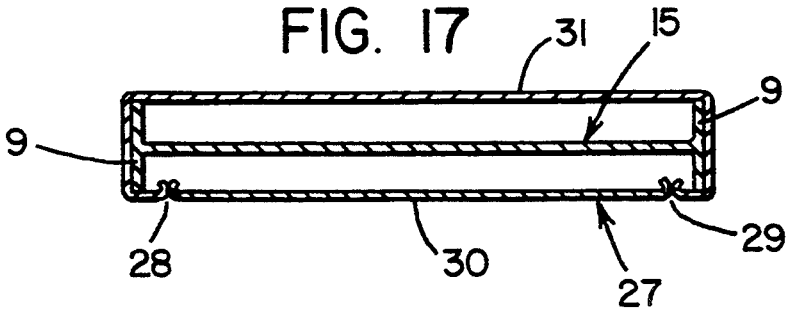
Figure 19:
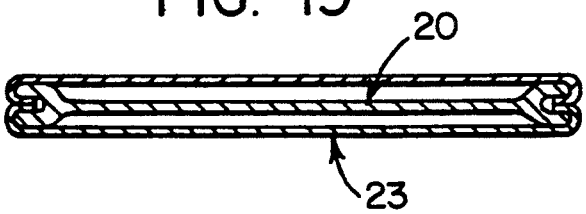
Figure 20:
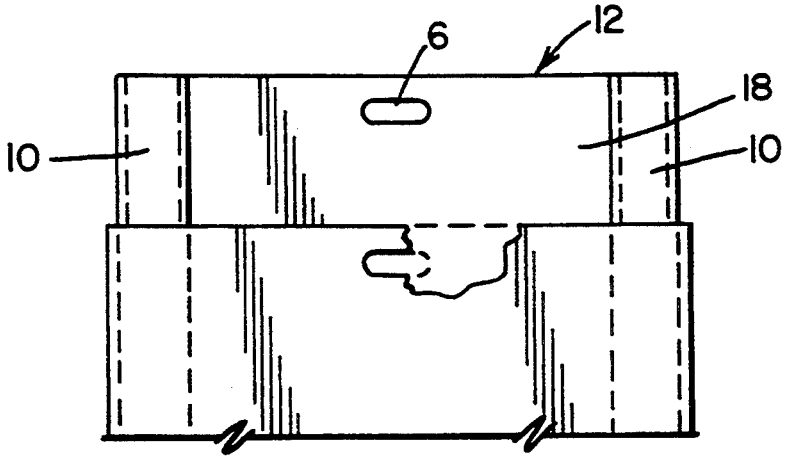
FIG. 20 is a partial elevation view of a partially assembled louver with slat insert being placed partially within a web sleeve.
Figure 21:
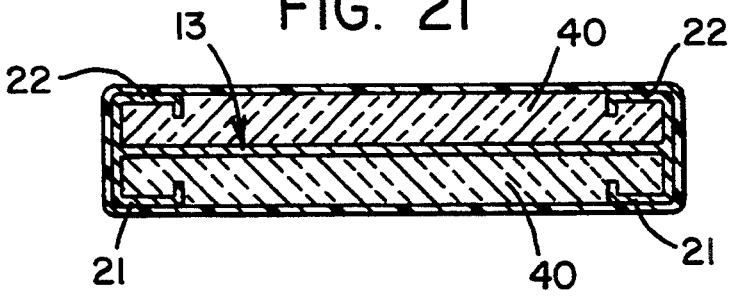
FIGS. 21–24 are cross-section views of assembled louvers where insulating members are positioned in the spaces between a web sleeve or envelope and a slat insert.
Figure 22:
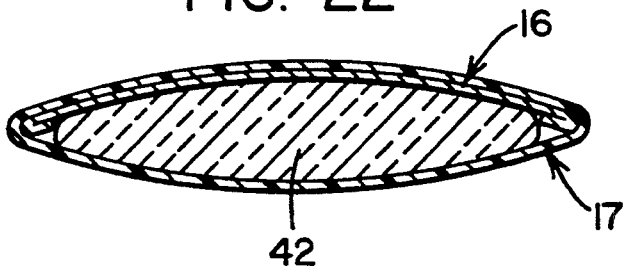
Figure 23:
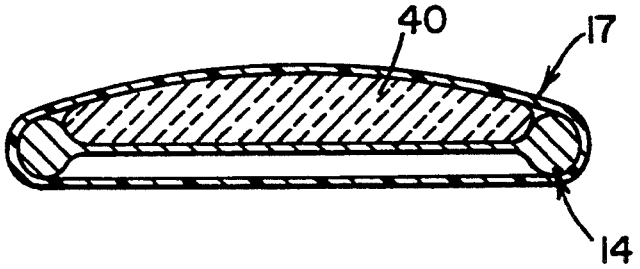

Assembled or partially assembled louvers embodying the present invention are shown in FIGS. 14 through 24. In FIG. 14 a louver assembly is depicted that comprises web sleeve 26 which surrounds slat insert 12. Web sleeve 26 with seam at 28 generally conforms to the periphery of slat insert 12. Space is provided between inward face 18 and the web sleeve spanning the flat portion between the lateral flanges. FIG. 15 similarly depicts a web assembly using a web sleeve 26 and slat insert 13 which contains both outward and inward facing flanges. In the example of FIG. 15, space is provided between both the inward and outward faces of slat insert 13 and the spanning web sleeve. In the case where a slat insert such as 14 is used as shown in FIG. 16, space is similarly provided between the inward and outward faces of the slat insert and the web sleeve 25. FIG. 17 depicts slat insert 15 placed inside web sleeve 27 which comprises two seams at 28 and 29. This web sleeve 27 further comprises inward facing web member 30 and outward facing web member 31. Both inward and outward facing web members 30 and 31 as pointed out can be advantageously and preferably constructed of dissimilar materials such as fabrics of different color. Seams 28 and 29 can be located such that they will not substantially interrupt the smooth appearance of the louver. FIG. 19 illustrates a preferable embodiment for use with web sleeve 23 surrounding slat insert 20 having lateral grooves which accept the seams. The web sleeve is attached by frictional means and the lateral edges have a smooth appearance. As stated above, web sleeves can be of particular size so as to be stretched taught when the slat is inserted. When it may be desirable to utilize a curved slat insert as depicted in FIG. 18, the web sleeve 25 spans across inner face 18 of slat insert 16 and creates intervening void space. This void space can optionally be filled by incorporating an insulating member as can be seen in FIG. 22 wherein web sleeve 17 surrounds the slat insert and insulating member 42. Insulating member 42 is preferably composed of lightweight material which exhibits good thermal insulating properties or sound deadening properties or both. FIG. 23 depicts the use of insulating members 40 with slat insert 14 and web sleeve 17. It is preferable that insulating materials are composed of low density flexible, soft and resilient material which exhibits conformability to the space provided. Polyurethane foam is an example of suitable insulating material.

Figure 24:
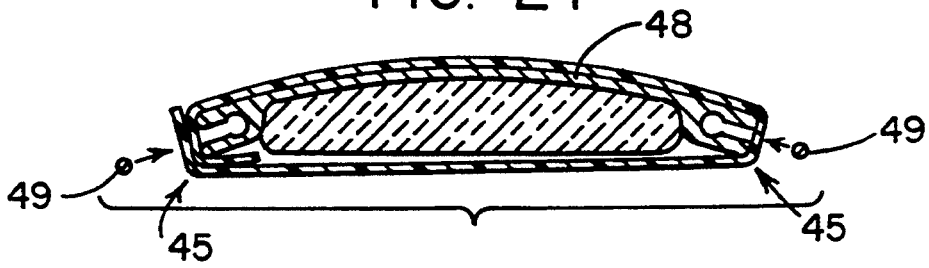
Figure 43:
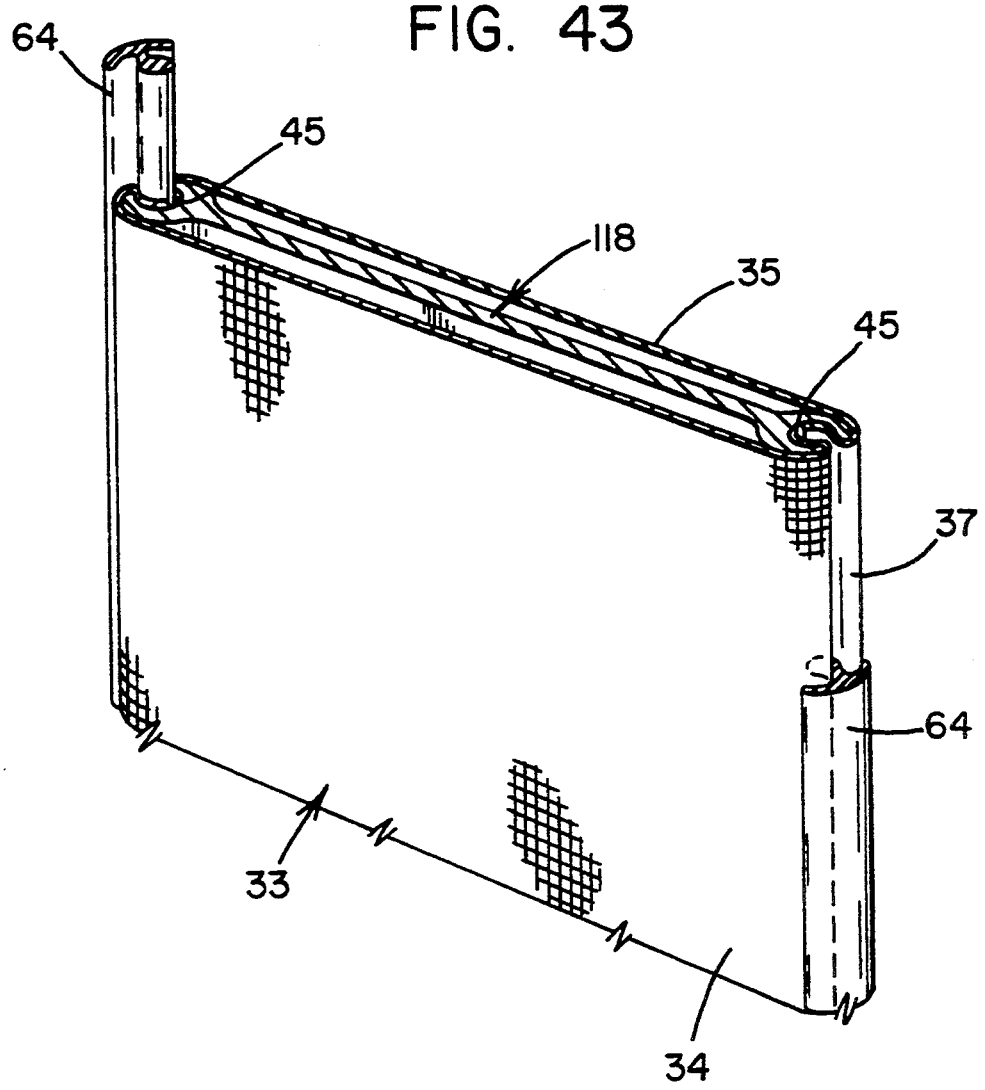
FIG. 43 is a perspective cut-away view of an assembled louver including a web sleeve and the slat insert of FIG. 38.

One embodiment of an assembled louver is shown in FIG. 24 wherein the slat insert 48 further comprises lateral web attachment means. The lateral attachment means of slat insert 48 comprise lateral channels at 45 which will accept a web envelope and insert bead 49. Insert beads 49 are sized in a manner so as to firmly engage the web within channels 45. It is advantageous to construct insert beads from materials having significant tensile strength and toughness such as nylon. Insert bead 49 will firmly retain web sleeves or envelopes in a taught state within channel 45. The bead can be forced longitudinally along the channel and pulled from the assembly to detach the web sleeve or envelope(s) when it is desired to interchange the web. This can be seen by analogy in the perspective in FIG. 43.

Figure 25:
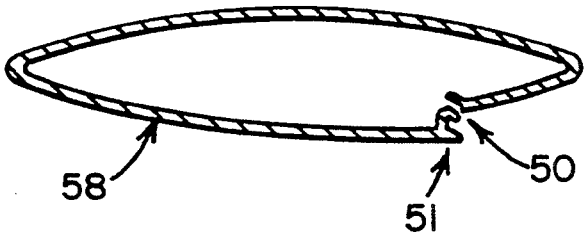
FIG. 25 is a cross-section view of a slat insert including a web attachment means disengaged.
Figure 26:
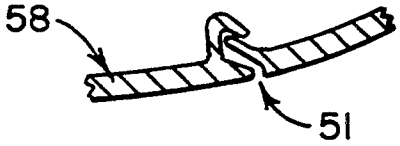
FIG. 26 is a enlarged cross-section view of the slat insert of FIG. 25 showing the web attachment means engaged.
Figure 33:
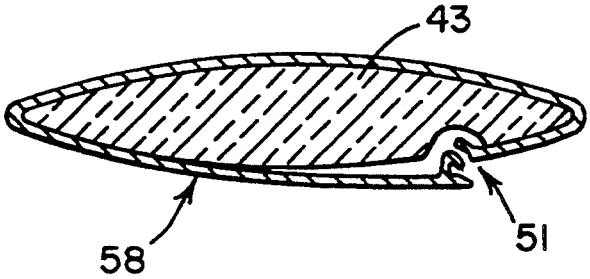
FIG. 33 is a cross-section view of the slat insert of FIG. 25 including an insulating member.

FIG. 25 illustrates slat insert 58 with attachment means shown at 51. In unassembled position, slat insert 58 comprises gap 50 which will accept the ends of web envelopes as depicted in FIG. 11. The attachment means at 51 is shown engaged in FIG. 26. The closure is depicted as complementing opposing members which reversibly interlock with one another. The flexibility of the material comprising slat insert 58 will allow for disengagement at 51 when it is desired to disassemble the louver in order to interchange the web envelope. Optionally an insulating member can be placed within slat insert 58. FIG. 33 includes insulating member 43 within slat insert 58.

Figure 27:
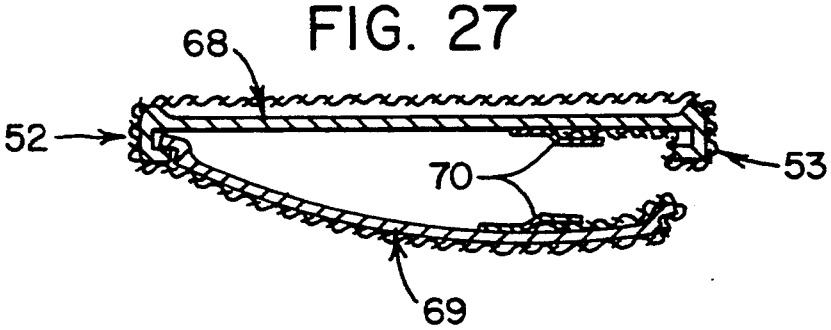
FIG. 27 is a cross-section view of a partially assembled louver with two slat insert members surrounded by a web envelope with the insert members about to be engaged.
Figure 28:
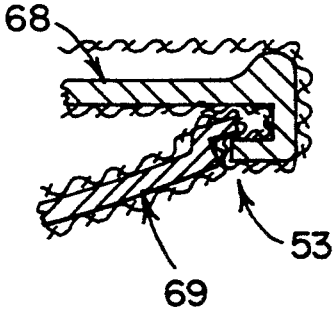
FIG. 28 is an enlarged cross-section of the louver assembly of FIG. 27 wherein the slat insert members are engaged thereby attaching the web envelope.

FIG. 27 depicts a partially assembled louver. Slat insert members 68 and 69 together will form an integral slat insert member when these members are engaged with each other at 52 and 53. During assembly, the two components 68 and 69 engage each other laterally at 52 wherein the lateral inward facing channel of 68 will receive the lateral edge of 69. The assembly is completed at 53 by engaging likewise members 68 and 69. This is shown in FIG. 28. The web envelope can be optionally attached by adhesive means at 70. Examples of adhesive means are adhesive tape or glue. Owing to the flexibility of materials employed in slat insert members 68 and 69, attachment means at 53 can be disengaged by flexing said slat members. The engagement of slat members 68 and 69 are designed so as to firmly hold the web envelope in a pinch at 53.

Figure 29:
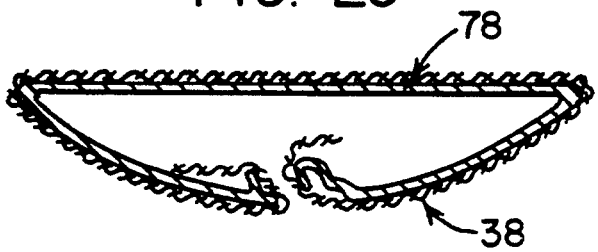
FIG. 29 is a cross-section of a partially assembled web sleeve and web envelope wherein the attachment means is disengaged.
Figure 30:
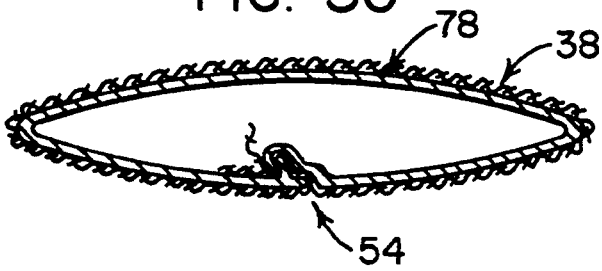
FIG. 30 is an enlarged cross-section of the louver assembly of FIG. 29 wherein the attachment means is engaged thereby attaching the web envelope.

The louver assembly depicted in FIG. 29 illustrates another embodiment of a slat insert which is placed within a web envelope. Slat insert 78 further comprises an attachment means shown disengaged in FIG. 29 and engaged in FIG. 30. The attachment means is designed to hold the web sleeve firmly when engaged and can be disengaged by compressing the lateral edges while parting at 54. FIGS. 29 and 30 depict a suggested location for the attachment means. It is understood here that attachment means can be located anywhere along the circumference of the slat insert.

Figure 31:
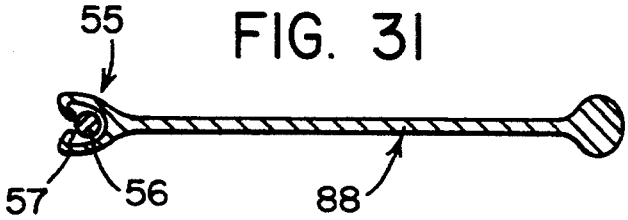
FIG. 31 is a slat insert including a singular, lateral web attachment means.
Figure 32:
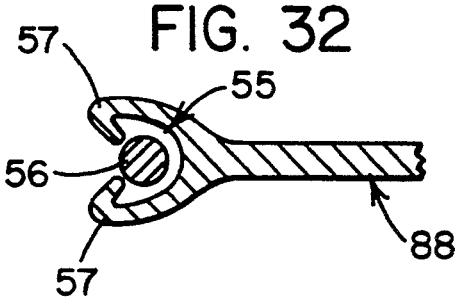
FIG. 32 is an enlarged cross-section view of the web attachment means of the slat insert of FIG. 31 including an insert bead engaged in a receiving channel.

Another example of a slat insert is shown in FIG. 31 wherein slat insert 88 comprises attachment means at one lateral edge of the slat insert. FIG. 32 illustrates the attachment means which further comprises channel 55 between wishbone members 57. The channel accepts insert bead 56 and a web sleeve or envelope. In assembling a louver with slat insert 88, first the web sleeve is placed over the slat insert with the ends of the web at channel 55. Insert bead 56 is forced over the web and into channel 55 thus securing the ends of a web envelope within the channel. The attachment means allows for removal of insert bead 56 by sliding bead 56 longitudinally along the channel so as to remove the bead and allow the web to be removed.

Figure 34:
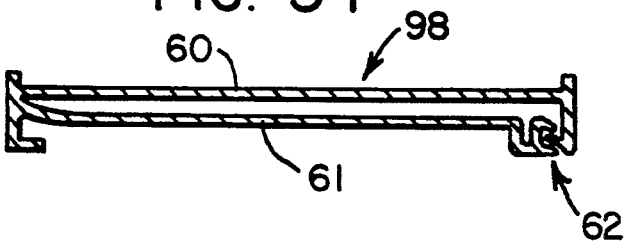
FIG. 34 is a cross-section view of a slat insert including a lateral web attachment means.
Figure 35:
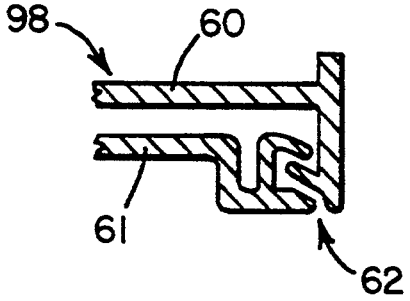
FIG. 35 is an enlarged cross-section view of the lateral web attachment means of FIG. 34.

Slat insert 98 is depicted in FIG. 34. Slat insert 98 comprises outer member 60 and inner member 61 which are integral at the lateral edge opposite 62. The engagement at 62 can be disengaged by flexing inner and outer members 60 and 61. Engagement means will accept the wrapped ends of a web envelope and the attached envelope in a pinch at 62.

Figure 36:
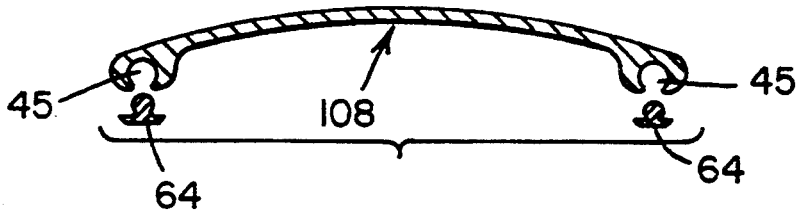
FIG. 36 is a cross-section view of a slat insert having lateral web attachment means including flanged insert beads.
Figure 37:
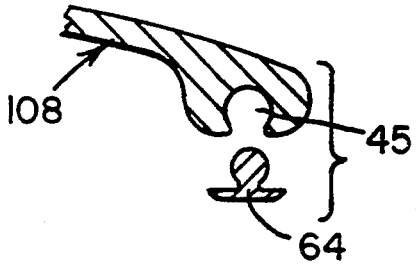
FIG. 37 is an enlarged cross-section view of a lateral attachment means of FIG. 36 including a flanged insert bead not engaged with the receiving channel.
Figure 38:
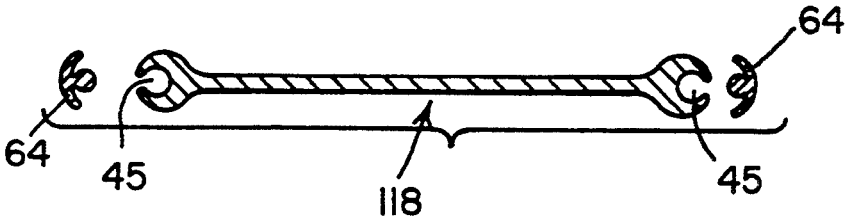
FIGS. 38–39 are cross-section views of slat inserts having lateral web attachment means including flanged insert beads.

A combination of features of a slat insert is shown in FIGS. 36 and 37. Slat insert 108 comprises lateral attachment means and is generally curved. Lateral attachment means shown in FIG. 37 comprises channels 45 which will accept a web envelope or sleeve retained when flanged insert beads 64 are inserted. A modified embodiment can be seen in FIG. 38. Slat insert 118 is not generally curved and comprises lateral attachment means oriented in the manner shown. The lateral attachment means utilize inner channels 45 which will accept flanged insert beads 64. A web sleeve or envelope is thus placed and aligned over slat insert 118 and fastened with flanged insert beads 64 into the openings of channels 45. Forcing the web into each channel creates a desirable tension.

Figure 39:
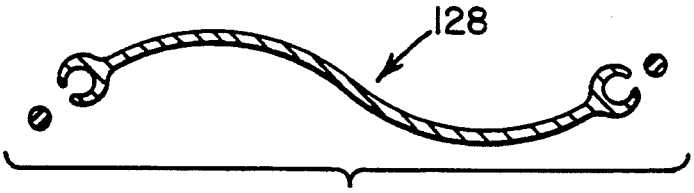

A slat insert similar to 118 is shown in FIG. 39. Slat insert 128 is curved generally into an S-shape and comprises lateral attachment means oriented in the manner depicted. The advantage of this embodiment lies in an engagement of assembled louvers wherein the louvers are aligned in overlapping fashion and more intimately contact one another and presents a pleated appearance in ensemble when positioned so to occlude the light or view in the opening.

Figure 40:
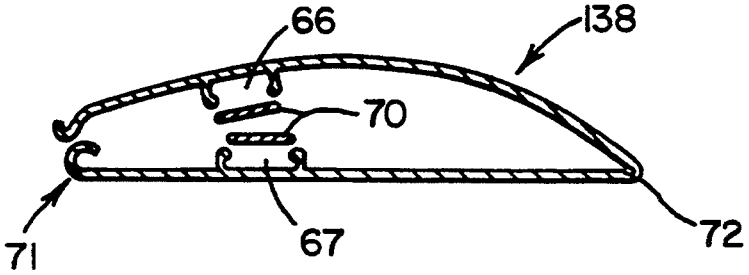
FIG. 40 is a cross-section view of a slat insert having inward facing web attachment means including web fastening strips and a singular slat closure means which is disengaged.
Figure 41:
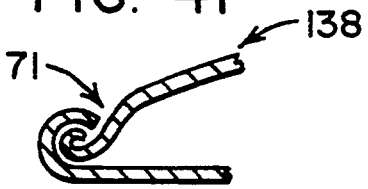
FIG. 41 is an enlarged cross-section absent a web envelope where the slat closure means is engaged.

FIG. 40 illustrates slat insert 138 having a novel attachment means for a web envelope which does not involve fastening means such as adhesive tape and the like. Slat insert 138 comprises inwardly facing channels 66 and 67 which will accept the overlapped edges of a web envelope which is wrapped around the outer perimeter of the slat insert. Channels 66 and 67 accept insert strips 70. A thinned or constricted region at 72 allows for easy flexing of the inner and outer members to allow the assembler to easily part the slat members and attach the web within the receiving channels. After attachment of a web envelope into inwardly facing channels 66 and 67 by slat insert strips 70; the louver assembly is completed when the slat insert is compressed and engaged at 71. The engagement at 71 can be seen in FIG. 41. The engagement can be disengaged when it is desired to interchange the web envelope.

Figure 42:
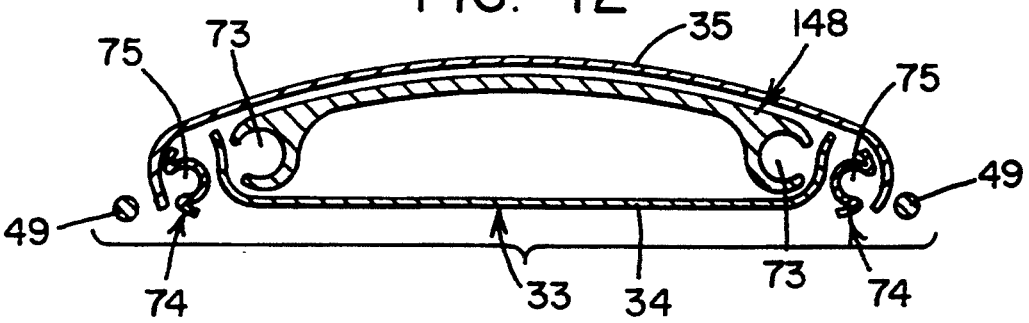
FIG. 42 is a cross-section view of a partially assembled louver including lateral attachment means and outward and inward facing web envelopes, and inner and outer web attachment beads.

FIG. 42 depicts a slat insert utilizing lateral attachment means which will accept two web envelopes. Lateral inner channels 73 will receive the inward facing web envelope 34 along with dual flanged insert beads 74. After dual flanged insert beads 74 are attached, these beads present outer channels 75. Outer channels 75 will accept the outward facing web envelope 35 and insert beads 49 which are forced into channel 75 thereby attaching the outer web envelope 35. In assembled form, the attachment means for inner web envelope 34 are completely occluded from view. The advantage of this louver assembly allows for the use of inner and outer web envelopes of dissimilar color or texture. The outward facing web can be interchanged with out removing the inner web envelope. Such an advantage is desired when the inward facing web envelope is chosen to match the interior of the room where the louver assembly is placed. Thus the outer web can be interchanged to accommodate warm or cold seasons. Light colored outer webs can be used in hot weather whereas darker colors can be used in cold weather.

The embodiments of the present invention shown and described herein are considered to be the most practical and preferred in simplicity of form and function. It is recognized, however, that departures may be made therefrom within the scope of the invention and that obvious modifications will occur to a person skilled in the art.

With reference to the drawings, louvers and louver slat inserts according to the invention are illustrated. Although the preferred embodiments are described in connection with individual louvers which are assembled into louvered systems such as vertical blinds, the louvers and slat inserts according to the invention can be employed in other types of coverings; windows, doors, dividers, and decorative screens.

It is claimed:

1. An elongate substantially rectangular louver comprising a removable louver slat insert and first and second webs attached thereto wherein said louver slat insert is defined by smooth and continuous lateral edges and smooth inward and outward faces, and wherein said webs attached thereto form a cylindrical web having an inner circumference similar to the outer circumference taken as a smooth line drawn around the inner periphery of said webs and said outer circumference taken as a smooth line around the outer extremes of said louver slat insert, wherein said webs are brought under tension by engaging attachment means on said louver slat insert, said attachment means comprising two opposing, lateral longitudinal inner receiving channels on said louver slat insert for accepting said first web, two inner insert beads each containing an outer longitudinal channel, and two outer insert beads, wherein said inner insert beads attach lateral portions of said first web covering said inward face, the lateral portions removably held within said inner receiving channels, and each said outer insert beads attach lateral portions of said second web covering said outward face, said outward web removably held within said outer longitudinal channels.

2. An elongate substantially rectangular louver comprising a two-piece louver slat insert and a web having lateral portions attached thereon, said louver slat insert containing inward and outward facing slat members wherein said outward facing slat member comprises opposing lateral receiving channels for engaging lateral edges of said inward facing slat member, one said channel on said outward facing slat member removably engages one lateral edge of said inward facing slat member, the opposite said lateral receiving channel on said outward facing slat removably engages the opposite lateral edge of said inward facing slat member thereby creating flexural tension in said slat members and retaining at least one lateral portion of said web in a pinch between at least one of said lateral receiving channels and a corresponding lateral edge of said inward facing slat member.

3. An elongate substantially rectangular louver comprising a louver slat and a web having lateral portions, said louver slat comprising inward and outward facing slat members integrally joined at a hinge means at one lateral edge, said louver slat including an attachment means for securing said web thereto comprising:

opposing interlocking latch means at lateral edges of said slat members opposite said hinge means for removably joining said slat members and said web in snap-fit engagement, said web lateral portions held in a pinch between said interlocking latch means and thereby covering said louver slat has been inserted.

4. A louver of claim 3 wherein said outward and inward facing slat members further comprise:

web attachment means on the inner walls of said slat members, each of said attachment means comprising:

a receiving channel for engaging said lateral portions of said web spanning said channels, and insert beads, said web is attached in snap-fit engagement within said receiving channels.

* * * * *